US012742404B2

(12) United States Patent
Kaneko et al.

(10) Patent No.: US 12,742,404 B2
(45) Date of Patent: Sep. 22, 2026

(54) INTERNAL COMBUSTION ENGINE

(71) Applicant: TOYOTA JIDOSHA KABUSHIKI KAISHA, Toyota (JP)

(72) Inventors: Kazuki Kaneko, Nagoya (JP); Nobuhiko Satake, Toyota (JP); Shinji Harada, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 19/072,028

(22) Filed: Mar. 6, 2025

(65) Prior Publication Data

US 2026/0022648 A1 Jan. 22, 2026

(30) Foreign Application Priority Data

Jul. 22, 2024 (JP) ..... 2024-116914

(51) Int. Cl.
*F01L 3/08* (2006.01)
*F01M 9/10* (2006.01)

(52) U.S. Cl.
CPC ..... *F01L 3/08* (2013.01); *F01M 9/103* (2013.01)

(58) Field of Classification Search
CPC ..... F01L 3/08; F01L 2303/00; F01L 2301/00; F01M 9/103
See application file for complete search history.

(56) References Cited

U.S. PATENT DOCUMENTS

| | | | | | |
|---|---|---|---|---|---|
| 2,775,024 | A * | 12/1956 | Seal | F16C 33/128 | 75/231 |
| 3,581,728 | A * | 6/1971 | Abraham | F01L 3/08 | 184/6 |
| 5,295,461 | A * | 3/1994 | Rao | F01L 3/08 | 123/188.9 |
| 5,493,776 | A * | 2/1996 | Kammeraad | F01L 3/08 | 29/888.46 |
| 11,719,138 | B2 * | 8/2023 | Ito | F01L 3/08 | 123/188.9 |
| 2011/0091344 | A1 * | 4/2011 | Christopherson, Jr. | B22F 1/09 | 75/243 |
| 2020/0332746 | A1 * | 10/2020 | Svensson | F01L 1/462 | |

FOREIGN PATENT DOCUMENTS

| | | |
|---|---|---|
| JP | S61-078206 U | 5/1986 |
| JP | 2023-082746 A | 6/2023 |

* cited by examiner

*Primary Examiner* — Grant Moubry
(74) *Attorney, Agent, or Firm* — SoraIP, Inc.

(57) ABSTRACT

The internal combustion engine includes a head cover, a cylinder head, an exhaust-side valve guide, an exhaust-side valve, and a valve operating mechanism. The head cover and the cylinder head define an accommodation space for accommodating the valve operating mechanism. The cylinder head includes an exhaust port and an exhaust-side fixing hole. The material of the exhaust-side valve guide is a porous material. The exhaust-side valve guide is inserted into the exhaust-side fixing hole. A portion of the exhaust-side valve guide protrudes from the exhaust-side fixing hole into the accommodation space. The exhaust-side valve guide is open at an outer peripheral face of the exposed portion, and includes a flow passage extending from the exposed portion to the insertion portion.

4 Claims, 5 Drawing Sheets

INTERNAL COMBUSTION ENGINE

CROSS-REFERENCE TO RELATED APPLICATION

This application claims priority to Japanese Patent Application No. 2024-116914 filed on Jul. 22, 2024, incorporated herein by reference in its entirety.

BACKGROUND

1. Technical Field

The present disclosure relates an internal combustion engine.

2. Description of Related Art

An internal combustion engine according to Japanese Unexamined Patent Application Publication No. 2023-082746 (JP 2023-082746 A) includes a head cover, a cylinder head, a valve guide, a valve, and a valve operating mechanism. The head cover and the cylinder head define an accommodation space for accommodating the valve operating mechanism. The cylinder head includes an exhaust port through which exhaust gas flows. The cylinder head includes a fixing hole. The fixing hole leads from the accommodation space to the exhaust port. The shape of the valve guide is cylindrical. The valve guide is inserted into the fixing hole. A portion of the valve guide protrudes from the fixing hole into the accommodation space. The valve includes a shaft body and a valve element. The shaft body is inserted inside the valve guide. The valve element extends from the shaft body. The valve element opens and closes the exhaust port.

SUMMARY

In an internal combustion engine such as in JP 2023-082746 A, generally, each member that is located in the accommodation space is lubricated with oil within this accommodation space. Accordingly, in the internal combustion engine according to JP 2023-082746 A, when the oil in the accommodation space adheres to a distal end portion of the valve guide that is located in the accommodation space, for example, this oil can be introduced in between an inner peripheral face of the valve guide and an outer peripheral face of the shaft body of the valve. However, in the internal combustion engine according to JP 2023-082746 A, there is a concern that the oil between the inner peripheral face of the valve guide and the outer peripheral face of the shaft body of the valve will be insufficient.

An internal combustion engine that solves the above issue includes

- a head cover, a cylinder head that is connected to the head cover, a valve guide that is cylindrical in shape and that is fixed to the cylinder head, a valve that is inserted into the valve guide, and a valve operating mechanism for operating the valve, in which
- the head cover and the cylinder head define an accommodation space for accommodating the valve operating mechanism,
- the cylinder head includes a gas passage through which gas flows, and a fixing hole that leads from the accommodation space to the gas passage,
- the valve includes a shaft body that is inserted inside the valve guide, and a valve element that extends from the shaft body to open and to close the gas passage,
- a material of the valve guide is a porous material,
- the valve guide is inserted into the fixing hole, and also a portion of the valve guide protrudes from the fixing hole into the accommodation space, and
- with a portion of the valve guide that is exposed to the accommodation space as an exposed portion and a portion that is inserted into the fixing hole as an insertion portion, the valve guide opens at an outer peripheral face of the exposed portion, and also includes a flow passage extending from the exposed portion to the insertion portion.

According to the above configuration, insufficiency of oil between the inner peripheral face of the valve guide and the outer peripheral face of the shaft body of the valve can be suppressed.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Outline of Configuration of Internal Combustion Engine

Hereinafter, an embodiment of the present disclosure will be described with reference to FIGS. 1 to 4. First, a schematic configuration of the internal combustion engine 100 will be described. In the following description, the front-rear, left-right, and up-down directions refer to directions viewed from a driver seated in the driver's seat of the vehicle in a state in which the internal combustion engine 100 is mounted on the vehicle.

Figure 1:
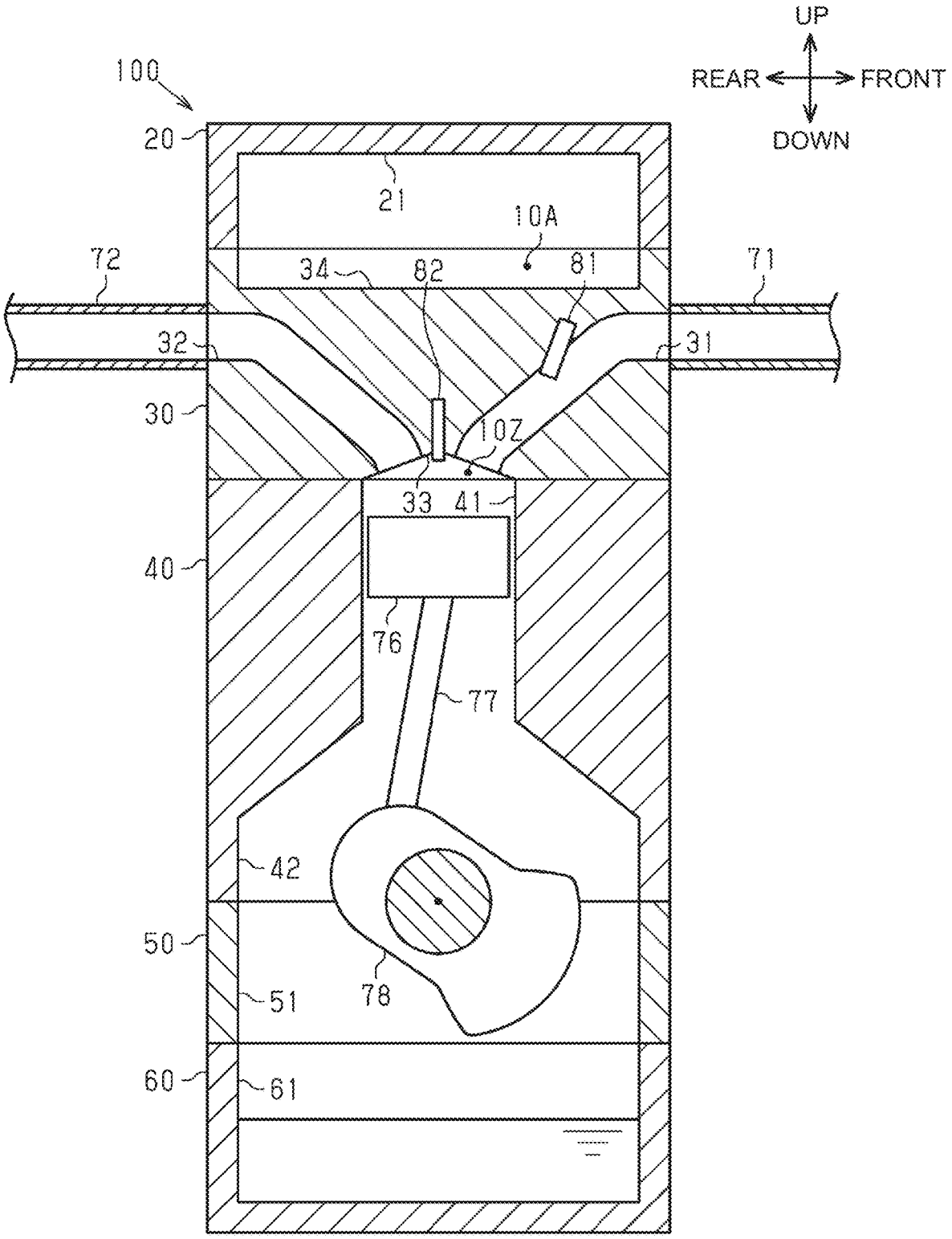
FIG. 1 is a cross-sectional view illustrating a schematic configuration of an internal combustion engine.

As illustrated in FIG. 1, the internal combustion engine 100 includes a head cover 20, a cylinder head 30, a cylinder block 40, a crankcase 50, and an oil pan 60. The internal combustion engine 100 includes an intake pipe 71, an exhaust pipe 72, a plurality of pistons 76, a plurality of connecting rods 77, a crankshaft 78, a plurality of fuel injection valves 81, and a plurality of ignition devices 82.

The cylinder block 40 has a quadrangular prism shape as a whole. The cylinder block 40 includes four cylinders 41 as internal spaces. The cylinder 41 has a substantially cylindrical shape. The cylinder 41 extends from the upper end of the cylinder block 40 to the vicinity of the upper and lower centers of the cylinder block 40. The cylinder 41 is a space for burning an air-fuel mixture of fuel and intake air. In the present embodiment, an example of the fuel of the internal combustion engine 100 is hydrogen. In the internal combustion engine 100, the crankshaft 78 extends to the left and right of the vehicle. Therefore, the internal combustion engine 100 is a so-called horizontal engine. In FIG. 1, only one cylinder 41 out of the four cylinders 41 is represented and illustrated.

The cylinder block 40 includes four upper spaces 42 as internal spaces. An upper end of the upper space 42 is connected to a lower end of the cylinder 41. The upper space 42 extends from the lower end of the cylinder 41 to the lower end of the cylinder block 40.

The crankcase 50 is connected to the lower end of the cylinder block 40. The crankcase 50 has a so-called ladder frame structure. Therefore, the crankcase 50 includes four lower spaces 51 as internal spaces. The lower space 51 penetrates from the upper end to the lower end of the crankcase 50. The upper end of the lower space 51 of the crankcase 50 is connected to the lower end of the upper space 42 of the cylinder block 40.

The oil pan 60 is connected to the lower end of the crankcase 50. The shape of the oil pan 60 is a generally quadrangular box shape having a bottom. Therefore, the oil pan 60 includes an oil chamber 61 as an internal space. The upper end of the oil chamber 61 is connected to the lower ends of the four lower spaces 51. The oil chamber 61 stores oil. The oil stored in the oil chamber 61 is supplied by an oil pump (not shown) to each unit of the internal combustion engine 100 including a valve operating mechanism 83, which will be described later. That is, the oil stored in the oil chamber 61 is also supplied to an accommodation space 10A to be described later. The oil supplied to each part of the internal combustion engine 100 is recirculated to the oil chamber 61 via a passage (not shown).

The piston 76 is located inside the cylinder 41. The piston 76 is connected to the crankshaft 78 via a connecting rod 77. The crankshaft 78 is rotatably supported between the cylinder block 40 and the crankcase 50. The piston 76 reciprocates inside the cylinder 41 by combustion of an air-fuel mixture of fuel and intake air in a combustion chamber 10Z to be described later. The crankshaft 78 is rotated by the reciprocating motion of the piston 76. The internal combustion engine 100 includes four pistons 76 and four connecting rods 77 corresponding to the four cylinders 41.

The cylinder head 30 is connected to the upper end of the cylinder block 40. The cylinder head 30 has a quadrangular prism shape as a whole. The cylinder head 30 includes four intake ports 31, four exhaust ports 32, four combustion recesses 33, and an internal space 34 as an internal space. The internal space 34 is recessed downward from the upper surface of the cylinder head 30. The combustion recess 33 is recessed upward from the lower surface of the cylinder head 30. The combustion recess 33 is located at a position facing the cylinder 41. The combustion recess 33 is connected to the upper end of the cylinder 41. The combustion recess 33, the cylinder 41, and the piston 76 define a combustion chamber 10Z in which an air-fuel mixture of fuel and intake air is combusted. In the present embodiment, the internal combustion engine 100 includes four combustion chamber 10Z.

The first end of the intake port 31 is connected to the combustion recess 33 of the combustion chamber 10Z. The second end of the intake port 31 is open to the front surface of the cylinder head 30. The intake pipe 71 is connected to the front surface of the cylinder head 30. The intake port 31 introduces the intake gases from the outside of the internal combustion engine 100 to the combustion chamber 10Z via the intake pipe 71.

The first end of the exhaust port 32 is connected to the combustion recess 33 of the combustion chamber 10Z. The second end of the exhaust port 32 is open to the rear surface of the cylinder head 30. The exhaust pipe 72 is connected to the rear surface of the cylinder head 30. The exhaust port 32 discharges exhaust gases from the combustion chamber 10Z to the outside of the internal combustion engine 100 via the exhaust pipe 72. In the present embodiment, each of the intake port 31 and the exhaust port 32 is an example of a gas passage through which gas flows. As described above, the fuel of the internal combustion engine 100 is hydrogen. Therefore, the exhaust gas generated by the combustion of hydrogen, which is a fuel, flows through the exhaust port 32.

The fuel injection valve 81 is attached to the cylinder head 30. The front end of the fuel injection valve 81 is located in the middle of the intake port 31. The fuel injection valve 81 injects fuel from a fuel tank (not shown) into the intake port 31. In the present embodiment, the internal combustion engine 100 includes four fuel-injection valves 81 corresponding to the four combustion chamber 10Z.

The ignition device 82 is attached to the cylinder head 30. The front end of the ignition device 82 is located in the combustion chamber 10Z. The ignition device 82 ignites an air-fuel mixture of fuel and intake air by spark discharge. In the present embodiment, the internal combustion engine 100 includes four ignition devices 82 corresponding to the four combustion chamber 10Z.

The head cover 20 is connected to the upper end of the cylinder head 30. The shape of the head cover 20 is a substantially square box shape having a top plate. Therefore, the head cover 20 includes an internal space 21 as an internal space. The internal space 21 of the head cover 20 and the internal space 34 of the cylinder head 30 define an accommodation space 10A for accommodating a valve operating mechanism 83 to be described later.

Surrounding Configuration of the Combustion Chamber

Figure 2:
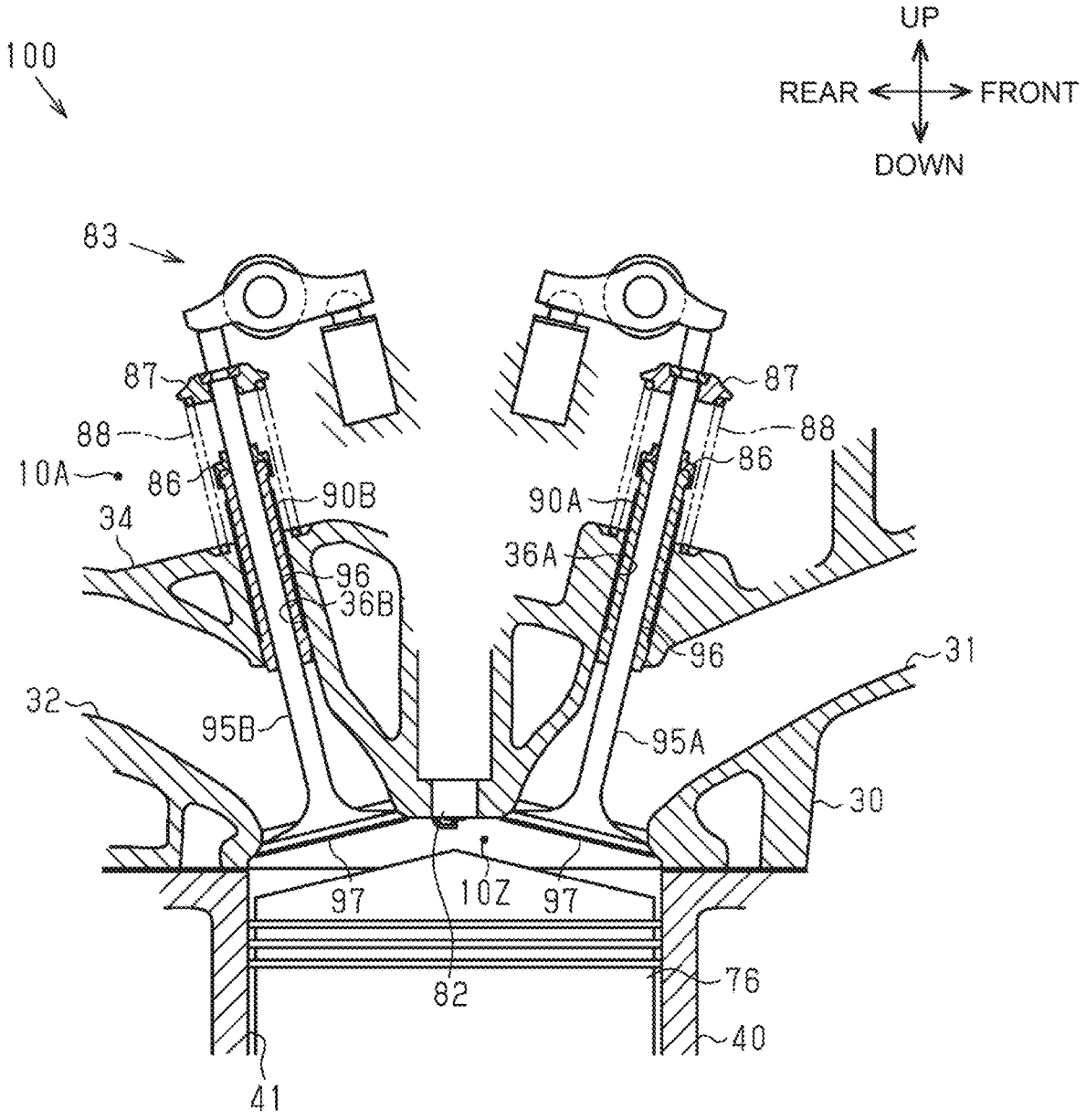
FIG. 2 is a cross-sectional view showing a peripheral configuration of the combustion chamber.

As shown in FIG. 2, the cylinder head 30 includes four intake-side fixing holes 36A and four exhaust-side fixing holes 36B as inner spaces. The intake-side fixing hole 36A extends from the accommodation space 10A to the intake port 31. The intake-side fixing hole 36A extends from the accommodation space 10A toward the connecting part of the intake port 31 and the combustion chamber 10Z. The shape of the intake-side fixing hole 36A is a substantially cylindrical shape. The exhaust-side fixing hole 36B extends from the accommodation space 10A to the exhaust port 32. The exhaust-side fixing hole 36B extends from the accommodation space 10A toward the connecting part of the exhaust port 32 and the combustion chamber 10Z. The exhaust-side fixing hole 36B has a substantially cylindrical shape. In the present embodiment, each of the intake-side fixing hole 36A and the exhaust-side fixing hole 36B is an exemplary fixing hole.

As shown in FIG. 2, the internal combustion engine 100 includes a valve operating mechanism 83, a plurality of stem seals 86, a plurality of retainers 87, and a plurality of valve springs 88. The internal combustion engine 100 includes a plurality of intake-side valve guides 90A, a plurality of exhaust-side valve guides 90B, a plurality of intake-side valves 95A, and a plurality of exhaust-side valve 95B. In the present embodiment, each of the intake-side valve guide 90A and the exhaust-side valve guide 90B is an exemplary valve guide. Each of the intake-side valve 95A and the exhaust-side valve 95B is an exemplary valve.

Figure 3:
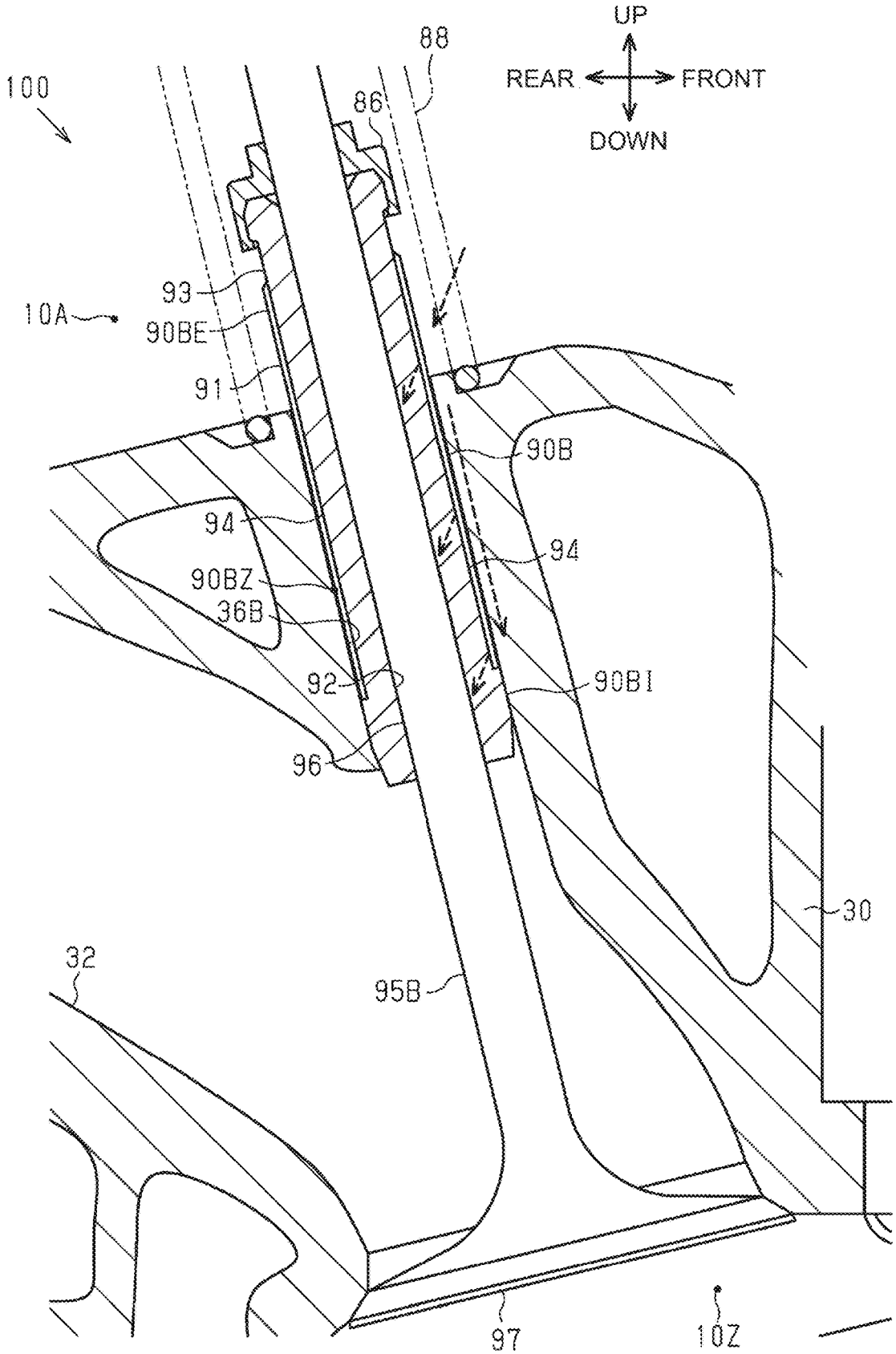
FIG. 3 is a cross-sectional view showing a peripheral configuration of the exhaust-side valve guide.

As shown in FIG. 3, the exhaust-side valve guide 90B is generally cylindrical in shape. The outer diameter of the exhaust-side valve guide 90B is substantially the same as the inner diameter of the exhaust-side fixing hole 36B. The exhaust-side valve guide 90B is fixed to the exhaust-side fixing hole 36B by press-fitting. In other words, the exhaust-side valve guide 90B is inserted into the exhaust-side fixing hole 36B. An upper end of the exhaust-side valve guide 90B is located in the accommodation space 10A. In other words, a portion including the upper end of the exhaust-side valve guide 90B protrudes from the exhaust-side fixing hole 36B to the accommodation space 10A. Further, a lower end of the exhaust-side valve guide 90B is located at a border between the exhaust-side fixing hole 36B and the exhaust port 32.

The material of the exhaust-side valve guide 90B is a porous material. Specifically, the material of the exhaust-side valve guide 90B is porous. An exemplary material of the exhaust-side valve guide 90B is an alloy obtained by sintering a metallic powder, so-called sintered alloy.

In the present embodiment, the exhaust-side valve guide 90B is manufactured as follows. First, an operator who manufactures the exhaust-side valve guide 90B forms an intermediate member of the exhaust-side valve guide 90B by sintering the metallic powder. At this time, the outer diameter of the intermediate member of the exhaust-side valve guide 90B is slightly larger than the outer diameter of the finished product of the exhaust-side valve guide 90B. Then, the operator forms the outer peripheral face 91 of the exhaust-side valve guide 90B by grinding the outer peripheral face of the intermediate member of the exhaust-side valve guide 90B. An exemplary grinding allowance for grinding is about "0.1 mm" in diameter.

In the following description, a part of the exhaust-side valve guide 90B exposed in the accommodation space 10A is also referred to as an exposed portion 90BE. Further, a part of the exhaust-side valve guide 90B that is inserted into the exhaust-side fixing hole 36B is also referred to as an insertion portion 90BI.

As shown in FIG. 2, the exhaust-side valve 95B includes a shaft body 96 and a valve element 97. The shaft body 96 has a generally circular rod shape. The outer diameter of the shaft body 96 is slightly smaller than the inner diameter of the exhaust-side valve guide 90B. The shaft body 96 is inserted into the exhaust-side valve guide 90B. A portion including the upper end of the shaft body 96 protrudes from the exhaust-side valve guide 90B and is located in the accommodation space 10A. A portion including the lower end of the shaft body 96 protrudes from the exhaust-side valve guide 90B and is located at the exhaust port 32. The valve element 97 extends from the lower end of the shaft body 96. The valve element 97 opens and closes the connecting part of the exhaust port 32 and the combustion chamber 10Z.

As shown in FIG. 3, the stem seal 86 is attached to the upper end of the exhaust-side valve guide 90B. The stem seal 86 is generally annular in shape. The stem seal 86 adjusts the quantity of oil flowing between the inner peripheral face 92 of the exhaust-side valve guide 90B and the outer peripheral face of the shaft body 96 of the exhaust-side valve 95B via the upper end of the exhaust-side valve guide 90B.

As shown in FIG. 2, the retainer 87 is mounted in the vicinity of the upper end of the shaft body 96 of the exhaust-side valve 95B. The valve spring 88 is located between the retainer 87 and the inner surface of the internal space 34 in the accommodation space 10A. The valve spring 88 applies a force to the exhaust-side valve 95B so as to close the exhaust-side valve 95B via the retainer 87.

The valve operating mechanism 83 contacts the upper end of the shaft body 96 of the exhaust-side valve 95B. The valve operating mechanism 83 transmits power to the shaft body 96 of the exhaust-side valve 95B in response to the rotation of the crankshaft 78, thereby opening the exhaust-side valve 95B against the force from the valve spring 88. Therefore, the valve operating mechanism 83 operates the exhaust-side valve 95B.

The shape of the intake-side valve guide 90A is generally cylindrical. The intake-side valve guide 90A is fixed to the intake-side fixing hole 36A by pressure insertion. The configuration of the intake-side valve guide 90A is the same as that of the exhaust-side valve guide 90B described above. Therefore, the configuration of the intake-side valve guide 90A will not be described.

The intake-side valve 95A includes a shaft body 96 and a valve element 97, similarly to the exhaust-side valve 95B described above. The shaft body 96 of the intake-side valve 95A is inserted into the intake-side valve guide 90A. The configuration of the intake-side valve 95A is the same as that of the exhaust-side valve 95B described above. Therefore, the configuration of the intake-side valve 95A will not be described. The configuration around the intake-side valve 95A, that is, the configuration related to the stem seal 86, the retainer 87, and the valve operating mechanism 83 is the same as the configuration around the exhaust-side valve 95B described above. Therefore, the configuration around the intake-side valve 95A will not be described.

Detailed Configuration of the Valve Guide

Figure 4:
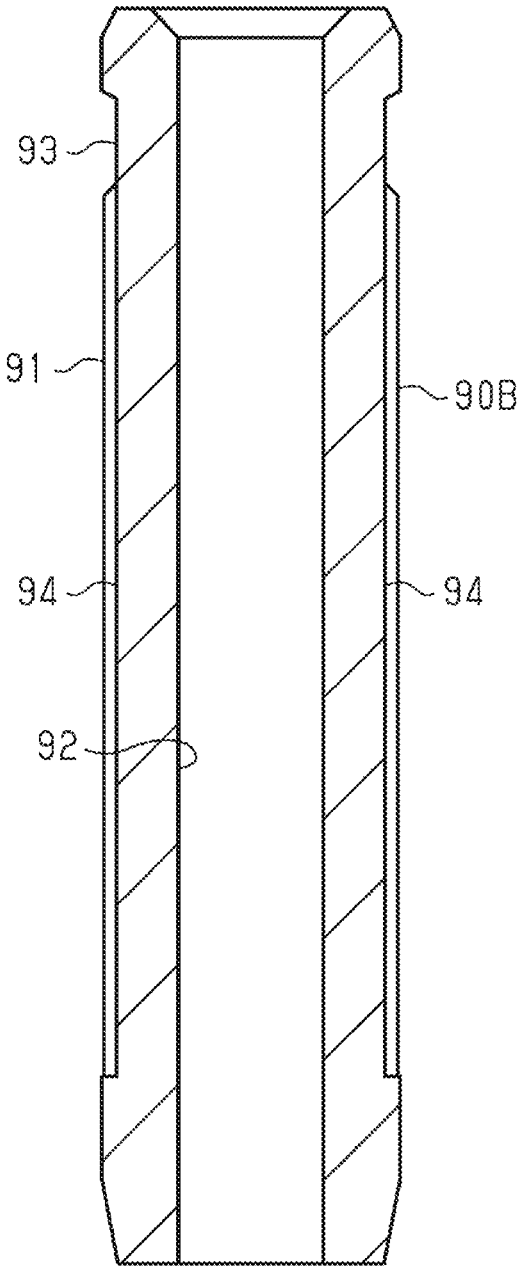
FIG. 4 is a cross-sectional view showing a configuration of an exhaust-side valve guide.

As shown in FIG. 4, the exhaust-side valve guide 90B includes an annular groove 93 and a plurality of flow passages 94. The annular groove 93 is recessed from the outer peripheral face 91 of the exhaust-side valve guide 90B. When viewed from the direction along the axis of the exhaust-side valve guide 90B as viewed from the exhaust-side valve guide 90B, the annular groove 93 has an annular shape. As shown in FIG. 3, the annular groove 93 is located near the upper end of the exhaust-side valve guide 90B. In other words, the annular groove 93 is located on the exposed portion 90BE of the exhaust-side valve guide 90B.

As shown in FIG. 4, the flow passage 94 is recessed from the outer peripheral face 91 of the exhaust-side valve guide 90B. In the present embodiment, the depth of the depression of the flow passage 94 is the same as the depth of the depression of the annular groove 93. An exemplary depth of the depression of the flow passage 94 is about several mm. The flow passage 94 extends along the axial line of the exhaust-side valve guide 90B. The first end of the flow passage 94 is connected to the annular groove 93. That is, as shown in FIG. 3, the first end of the flow passage 94 is located on the exposed portion 90BE of the exhaust-side valve guide 90B. Further, the second end of the flow passage 94 is located on insertion portion 90BI of the inlet part of the exhaust-side valve guide 90B. In other words, the flow passage 94 extends from the exposed portion 90BE of the exhaust-side valve guide 90B to the insertion portion 90BI. Here, an intermediate position along the axial line of the exhaust-side valve guide 90B with respect to the insertion portion 90BI of the exhaust-side valve guide 90B is referred to as an intermediate position 90BZ. The flow passage 94 extends from the exposed portion 90BE of the exhaust-side valve guide 90B to the portion on the exhaust port 32 side with respect to the intermediate position 90BZ in the insertion portion 90BI. Further, the flow passage 94 is a groove opened at the outer peripheral face 91 of the exhaust-side valve guide 90B over the entire area from the exposed portion 90BE to the insertion portion 90BI. Further, the flow passage 94 is in communication with the accommodation space 10A and is closed with respect to the exhaust port 32. In other words, the flow passage 94 is not in communication with the exhaust port 32. An exemplary dimension perpendicular to the direction in which the flow passage 94 extends and the direction in which the flow passage 94 is recessed, that is, a dimension in the widthwise direction of the flow passage 94 is about several mm.

In the present embodiment, the exhaust-side valve guide 90B includes four flow passages 94. When viewed from the direction along the axial line of the exhaust-side valve guide 90B as viewed in the exhaust-side valve guide 90B, the four flow passages 94 are arranged at regular intervals in the circumferential direction of the outer peripheral face 91 of the exhaust-side valve guide 90B.

Operation of this Embodiment

The material of the exhaust-side valve guide 90B is a porous material. Therefore, when the oil existing in the accommodation space 10A adheres to the exhaust-side valve guide 90B, the oil permeates into the exhaust-side valve guide 90B. However, in the manufacturing stage of the exhaust-side valve guide 90B, the outer peripheral face 91 of the exhaust-side valve guide 90B is formed by grinding the outer peripheral face of the intermediate member of the exhaust-side valve guide 90B. Therefore, the fine cavity of the outer peripheral face 91 of the exhaust-side valve guide 90B disappears due to the grinding. Consequently, even if the oil adheres to the outer peripheral face 91 of the exhaust-side valve guide 90B, the oil hardly penetrates from the outer peripheral face 91 of the exhaust-side valve guide 90B to the inside.

Effect of this Embodiment (1) As shown in FIG. 4, in the present embodiment, the exhaust-side valve guide 90B includes a flow passage 94. Here, in the above-described grinding process, the minute cavities in the inner surface of the flow passage 94 do not disappear. Therefore, as indicated by a broken line arrow in FIG. 3, when the oil present in the accommodation space 10A reaches the flow passage 94 of the exhaust-side valve guide 90B, the oil permeates into the inside through the fine cavity of the inner surface of the flow passage 94. Then, the oil is introduced between the inner peripheral face 92 of the exhaust-side valve guide 90B and the outer peripheral face of the shaft body 96 of the exhaust-side valve 95B. Further, the flow passage 94 extends from the exposed portion 90BE of the exhaust-side valve guide 90B to the insertion portion 90BI. Therefore, as indicated by a broken line arrow in FIG. 3, the oil that has reached the flow passage 94 also flows from the exposed portion 90BE to the insertion portion 90BI in the flow passage 94. Thus, the oil is easily introduced not only between the inner peripheral face 92 of the exposed portion 90BE and the outer peripheral face of the shaft body 96 of the exhaust-side valve 95B, but also between the inner peripheral face 92 of the insertion portion 90BI and the outer peripheral face of the shaft body 96 of the exhaust-side valve 95B. Consequently, it is possible to prevent insufficient oil between the inner peripheral face 92 of the exhaust-side valve guide 90B and the outer peripheral face of the shaft body 96 of the exhaust-side valve 95B. The intake-side valve guide 90A achieves the same advantages as the exhaust-side valve guide 90B described above.

(2) As shown in FIG. 3, the flow passage 94 extends from the exposed portion 90BE of the exhaust-side valve guide 90B to the portion on the exhaust port 32 side with respect to the intermediate position 90BZ in the insertion portion 90BI. In other words, the flow passage 94 extends from the exposed portion 90BE of the exhaust-side valve guide 90B to a portion close to the exhaust port 32. Therefore, it is possible to introduce the oil into a part between the inner peripheral face 92 of the exhaust-side valve guide 90B and the outer peripheral face of the shaft body 96 of the exhaust-side valve 95B that is close to the exhaust port 32, which is particularly likely to be insufficient in oil. The intake-side valve guide 90A achieves the same advantages as the exhaust-side valve guide 90B described above.

(3) As shown in FIG. 3, the flow passage 94 is in communication with the accommodation space 10A and is closed with respect to the exhaust port 32. Since the flow passage 94 is closed with respect to the exhaust port 32 in this manner, it is possible to prevent the oil that has reached the flow passage 94 from flowing from the flow passage 94 to the exhaust port 32. If the flow of oil from the flow passage 94 to the exhaust port 32 is suppressed, the amount of oil present in the accommodation space 10A can be suppressed from being excessively reduced, or the amount of oil stored in the oil chamber 61 can be suppressed from being excessively reduced. In addition, the intake-side valve guide 90A has the same advantages as the exhaust-side valve guide 90B described above.

(4) Exhaust gas generated by combustion of hydrogen, which is fuel, flows through the exhaust port 32. Here, the amount of the carbon polymer contained in the exhaust gas is smaller than the amount of the carbon polymer contained in the exhaust gas of the gasoline engine, for example. Therefore, it is not expected that the space between the inner peripheral face 92 of the exhaust-side valve guide 90B and the outer peripheral face of the shaft body 96 of the exhaust-side valve 95B is lubricated by the carbon-containing polymer. In addition, the amount of moisture contained in the exhaust gas is larger than the amount of moisture contained in the exhaust gas of the gasoline engine, for example. Therefore, since the moisture contained in the exhaust gas reaches between the inner peripheral face 92 of the exhaust-side valve guide 90B and the outer peripheral face of the shaft body 96 of the exhaust-side valve 95B, the lubricating performance by oil tends to deteriorate. In other words, the quantity of oil required between the inner peripheral face 92 of the exhaust-side valve guide 90B and the outer peripheral face of the shaft body 96 of the exhaust-side valve 95B tends to be increased. Therefore, it is particularly preferable to apply the present technique to an exhaust-side valve guide 90B of an internal combustion engine 100 fueled by hydrogen, a so-called hydrogen engine.

Figure 5:
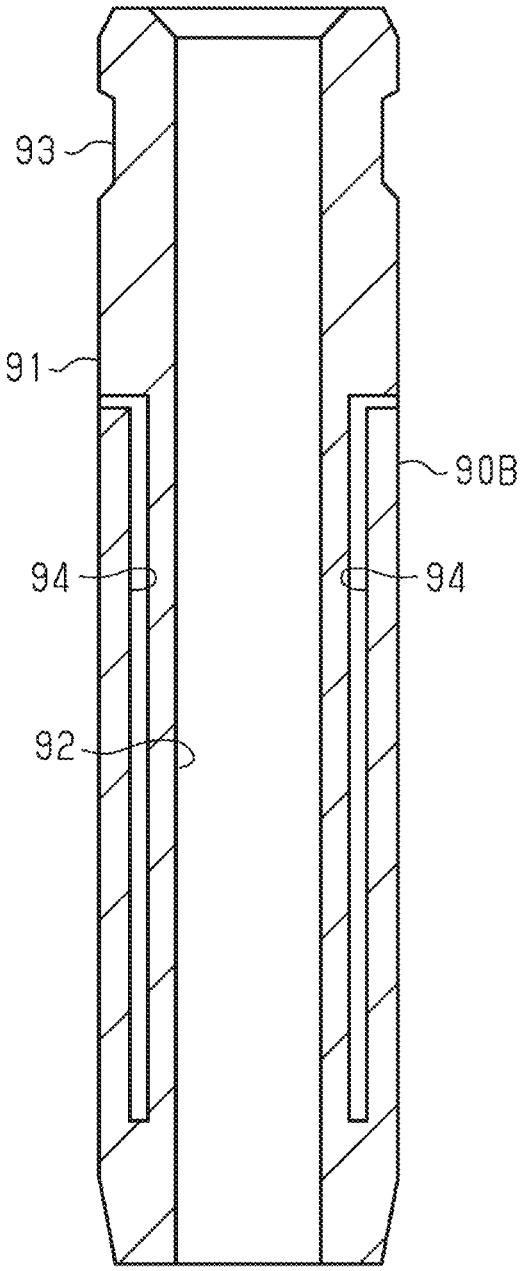
FIG. 5 is a cross-sectional view illustrating a configuration of an exhaust-side valve guide according to a modification.

(5) As illustrated in FIG. 3, the flow passage 94 is a groove opened at the outer peripheral face 91 of the exhaust-side valve guide 90B over the entire area from the exposed portion 90BE to the insertion portion 90BI. In other words, the flow passage 94 is a groove opened at the outer peripheral face 91 of the exhaust-side valve guide 90B in the entire area where the flow passage 94 is present. According to this configuration, the configuration of the exhaust-side valve guide 90B is simpler than, for example, the configuration in which the flow passage 94 as a passage between the outer peripheral face 91 and the inner peripheral face 92 of the exhaust-side valve guide 90B extends from the exposed portion 90BE to the insertion portion 90BI as shown in FIG. 5. Therefore, the manufacturing process of the exhaust-side valve guide 90B is suppressed from becoming complicated. Accordingly, the manufacturing cost of the exhaust-side valve guide 90B can be suppressed. The intake-side valve guide 90A achieves the same advantages as the exhaust-side valve guide 90B described above.

Example of Change

The present embodiment can be modified and implemented as follows. The present embodiment and modification examples described below may be carried out in combination of each other within a technically consistent range.

In the above embodiment, the configuration of the exhaust-side valve guide 90B may be changed.

For example, the four flow passages 94 may not be arranged at regular intervals in the circumferential direction of the outer peripheral face 91 of the exhaust-side valve guide 90B.

For example, the exhaust-side valve guide 90B may include three or fewer flow passages 94 or five or more flow passages 94. In this case, the position of the flow passage 94 may be appropriately adjusted. In addition, there is a viewpoint of suppressing variation in the quantity of oil between the inner peripheral face 92 of the exhaust-side valve guide 90B and the outer peripheral face of the shaft body 96 of the exhaust-side valve 95B. In this respect, it is preferable that the plurality of flow passages 94 are arranged at regular intervals in the circumferential direction of the exhaust-side valve guide 90B.

For example, the second end of the flow passage 94 may be located at a position to the accommodation space 10A with respect to the intermediate position 90BZ in the insertion portion 90BI. In other words, the flow passage 94 may not extend from the exposed portion 90BE of the exhaust-side valve guide 90B to the portion on the exhaust port 32 side with respect to the intermediate position 90BZ in the insertion portion 90BI.

For example, the flow passage 94 may be in communication with the exhaust port 32. As a specific example, the flow passage 94 may be in communication with the exhaust port 32 as long as the amount of oil flowing from the flow passage 94 to the exhaust port 32 is acceptable.

For example, the flow passage 94 may not extend along the axial line of the exhaust-side valve guide 90B. As a specific example, the flow passage 94 may be a spiral groove around the axial line of the exhaust-side valve guide 90B.

For example, the relationship between the flow passage 94 and the annular groove 93 may be changed. As a specific example, the depth of the depression of the flow passage 94 may be different from the depth of the depression of the annular groove 93. As a specific example, the flow passage 94 may not be connected to the annular groove 93.

For example, the flow passage 94 may not be a groove opened at the outer peripheral face 91 of the exhaust-side valve guide 90B over the entire region from the exposed portion 90BE to the insertion portion 90BI. As a specific example, as illustrated in FIG. 5, the flow passage 94 may be a passage opened only by a part of the outer peripheral face 91 of the exposed portion 90BE. The flow passage 94 may extend from the exposed portion 90BE to the insertion portion 90BI of the exhaust-side valve guide 90B. The exhaust-side valve guide 90B shown in FIG. 5 may be manufactured as follows, for example. First, the operator forms the first intermediate member of the exhaust-side valve guide 90B by sintering the metallic powder. Further, the operator forms the second intermediate member of the exhaust-side valve guide 90B by sintering the metallic powder. Here, the first intermediate member corresponds to a portion including the upper end of the exhaust-side valve guide 90B. The second intermediate member corresponds to a part of the exhaust-side valve guide 90B other than the first intermediate member. Subsequently, the worker forms the flow passage 94 in the second intermediate member by machining using the cutting tool. Thereafter, the operator forms the intermediate member by joining the first intermediate member and the second intermediate member. Then, the operator forms the outer peripheral face 91 of the exhaust-side valve guide 90B by grinding the outer peripheral face of the intermediate member of the exhaust-side valve guide 90B. Since the above-described manufacturing process is an example, other manufacturing processes can be employed.

For example, the material of the exhaust-side valve guide 90B is not limited to sintered alloy. In other words, the material of the exhaust-side valve guide 90B may be a porous metal other than sintered alloy. Further, the material of the exhaust-side valve guide 90B may be a non-metallic porous material.

For example, the manufacturing process of the exhaust-side valve guide 90B may be changed. Specifically, an operator who manufactures the exhaust-side valve guide 90B first forms an intermediate member of the exhaust-side valve guide 90B by sintering the metallic powder. At this time, the worker may form the flow passage 94 at the forming stage of the intermediate member. In addition, the worker does not have to form the flow passage 94 at the forming stage of the intermediate member. When the flow passage 94 is not formed in the forming step of the intermediate member, the operator may form the flow passage 94 by cutting the outer peripheral face of the intermediate member of the exhaust-side valve guide 90B after forming the intermediate member. Then, the operator may form the outer peripheral face 91 of the exhaust-side valve guide 90B by grinding the outer peripheral face of the intermediate member of the exhaust-side valve guide 90B.

The above-described modification is not limited to the configuration related to the exhaust-side valve guide 90B. That is, the above-described change can be applied not only to the configuration related to the exhaust-side valve guide 90B but also to the configuration related to the intake-side valve guide 90A.

In the above-described embodiment, the configuration of the internal combustion engine 100 may be changed.

For example, the fuel of the internal combustion engine 100 is not limited to hydrogen. As a specific example, the fuel of the internal combustion engine 100 may be gasoline, light oil, or the like. That is, the present technology can be applied not only to a hydrogen engine but also to a hydrogen engine.

For example, among the plurality of valve guides included in the internal combustion engine 100, a technique relating to the flow passage 94 may be applied only to a part of the valve guides. Specifically, only one of the intake-side valve guide 90A and the exhaust-side valve guide 90B may include the flow passage 94. Further, as a specific example, only a part of the exhaust-side valve guide 90B among the plurality of exhaust-side valve guide 90B may be provided with the flow passage 94. Similarly, of the plurality of intake-side valve guide 90A, only a part of the intake-side valve guide 90A may be provided with the flow passage 94.

What is claimed is:

1. An internal combustion engine, comprising:

a head cover;

a cylinder head that is connected to the head cover;

a valve guide that is cylindrical in shape and that is fixed to the cylinder head;

a valve that is inserted into the valve guide; and a valve operating mechanism for operating the valve, wherein the head cover and the cylinder head define an accommodation space for accommodating the valve operating mechanism, the cylinder head includes a gas passage through which gas flows, and a fixing hole that leads from the accommodation space to the gas passage, the valve includes a shaft body that is inserted inside the valve guide, and a valve element that extends from the shaft body to open and to close the gas passage, a material of the valve guide is a porous material, the valve guide is inserted into the fixing hole, and also a portion of the valve guide protrudes from the fixing hole into the accommodation space, with a portion of the valve guide that is exposed to the accommodation space as an exposed portion and a portion that is inserted into the fixing hole as an insertion portion, the valve guide opens at an outer peripheral face of the exposed portion, and also includes a flow passage extending from the exposed portion to the insertion portion, and the flow passage is a groove that opens at an outer peripheral face of the valve guide over an entire area from the exposed portion to the insertion portion.

2. The internal combustion engine according to claim 1, wherein, with respect to the insertion portion, with a position that is intermediate in a direction along an axial line of the valve guide as an intermediate position, the flow passage extends from the exposed portion to a portion of the insertion portion on a gas passage side with respect to the intermediate position.

3. The internal combustion engine according to claim 2, wherein the flow passage is in communication with the accommodation space, and also is closed off with respect to the gas passage.

4. The internal combustion engine according to claim 1, wherein the gas passage is an exhaust port through which exhaust gas that is generated by combustion of hydrogen, that is a fuel, flows.

* * * * *